US010766739B2

(12) United States Patent
Fargo et al.

(10) Patent No.: US 10,766,739 B2
(45) Date of Patent: Sep. 8, 2020

(54) ASSEMBLY FOR ACTUATING AN ELEVATOR CAR BRAKE

(71) Applicant: Otis Elevator Company, Farmington, CT (US)

(72) Inventors: Richard N. Fargo, Plainville, CT (US); Xiaodong Luo, South Windsor, CT (US); Enrico Manes, Feeding Hills, MA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 362 days.

(21) Appl. No.: 15/545,192

(22) PCT Filed: Jan. 19, 2016

(86) PCT No.: PCT/US2016/013889

§ 371 (c)(1),
(2) Date: Jul. 20, 2017

(87) PCT Pub. No.: WO2016/118496

PCT Pub. Date: Jul. 28, 2016

(65) Prior Publication Data

US 2017/0369277 A1 Dec. 28, 2017

Related U.S. Application Data

(60) Provisional application No. 62/105,943, filed on Jan. 21, 2015.

(51) Int. Cl.
*B66B 1/32* (2006.01)
*B66B 5/00* (2006.01)
(Continued)

(52) U.S. Cl.
CPC ..... *B66B 1/32* (2013.01); *B66B 5/0068* (2013.01); *B66B 5/16* (2013.01); *B66B 9/00* (2013.01); *B66B 9/003* (2013.01)

(58) Field of Classification Search
CPC ..... B66B 5/16; B66B 5/0068; B66B 1/32
See application file for complete search history.

(56) References Cited

U.S. PATENT DOCUMENTS 8,162,108 B2 * 4/2012 Sirigu ..... B66B 5/0068 187/289
2014/0116811 A1 * 5/2014 Aulanko ..... B66B 5/0068 187/359

FOREIGN PATENT DOCUMENTS

CN 1331652 A 1/2002
CN 101072723 A 11/2010
(Continued)

OTHER PUBLICATIONS

Chinese First Office Action and Search Report for application CN 201680006825.1, dated Sep. 28, 2018, 6 pages.
(Continued)

*Primary Examiner* — Diem M Tran
(74) *Attorney, Agent, or Firm* — Cantor Colburn LLP

(57) ABSTRACT

An assembly 28 for actuating and controlling braking of a car of an elevator system is provided. The assembly includes at least one braking device 20 mounted on the car, supported between the car and a hoistway for movement with the car within the hoistway, and configured to apply a braking force to the car. The assembly also includes at least one corresponding actuator 34 supported by the hoistway and configured to selectively engage the braking device to prevent movement of the car.

13 Claims, 3 Drawing Sheets

(51) Int. Cl.
*B66B 5/16* (2006.01)
*B66B 9/00* (2006.01)

(56) References Cited

FOREIGN PATENT DOCUMENTS

| | | | |
|---|---|---|---|
| EP | 1422182 | A1 | 5/2004 |
| JP | 2004010272 | A | 1/2004 |
| JP | 2007108777 | A | 4/2007 |
| JP | 2008265908 | A | 11/2008 |
| WO | 2006062503 | A1 | 6/2006 |
| WO | 2014049387 | A1 | 4/2014 |

OTHER PUBLICATIONS

International Search Report and Written Opinion for application PCT/US2016/013889, dated May 10, 2016, 11pgs.

* cited by examiner

ASSEMBLY FOR ACTUATING AN ELEVATOR CAR BRAKE

FIELD OF INVENTION

The subject matter disclosed herein relates generally to the field of elevators and, more particularly, to a multi-car, ropeless elevator system.

BACKGROUND

Ropeless elevator systems, also referred to as "self-propelled elevator systems," are useful in certain applications (e.g., high-rise buildings) where the mass of the ropes for a roped system is prohibitive and there is a desire for multiple elevator cars to travel in a single lane of a hoistway. There exist ropeless elevator systems in which a first lane is designated for upward-traveling cars and a second lane is designated for downward-traveling cars. A transfer station at each end of the hoistway is used to move cars horizontally between the first and second lanes.

In these elevator systems, batteries or power rails, for example, power brakes to lift and hold the respective cars. Toward this end, the brakes are generally located on the respective movable cars, and control systems and drives are stationary and located in the hoistway. Operation of and communication between the brakes and corresponding drives are configured to be closely coordinated with each other.

BRIEF DESCRIPTION OF INVENTION

According to a non-limiting exemplary embodiment of the invention, an assembly for actuating and controlling braking of a car of an elevator system is provided. The assembly includes at least one braking device mounted on the car, supported between the car and a hoistway for movement with the car within the hoistway, and configured to apply a braking force to the car. The assembly also includes at least one corresponding actuator supported by the hoistway and configured to selectively engage the braking device to prevent movement of the car.

BRIEF DESCRIPTION OF DRAWINGS

The subject matter that is regarded as the invention is particularly pointed out and distinctly claimed in the claims at the conclusion of the specification. The foregoing and other features and advantages of the invention are apparent from the following detailed description taken in conjunction with the accompanying drawing in which:

DETAILED DESCRIPTION OF INVENTION

Figure 1:
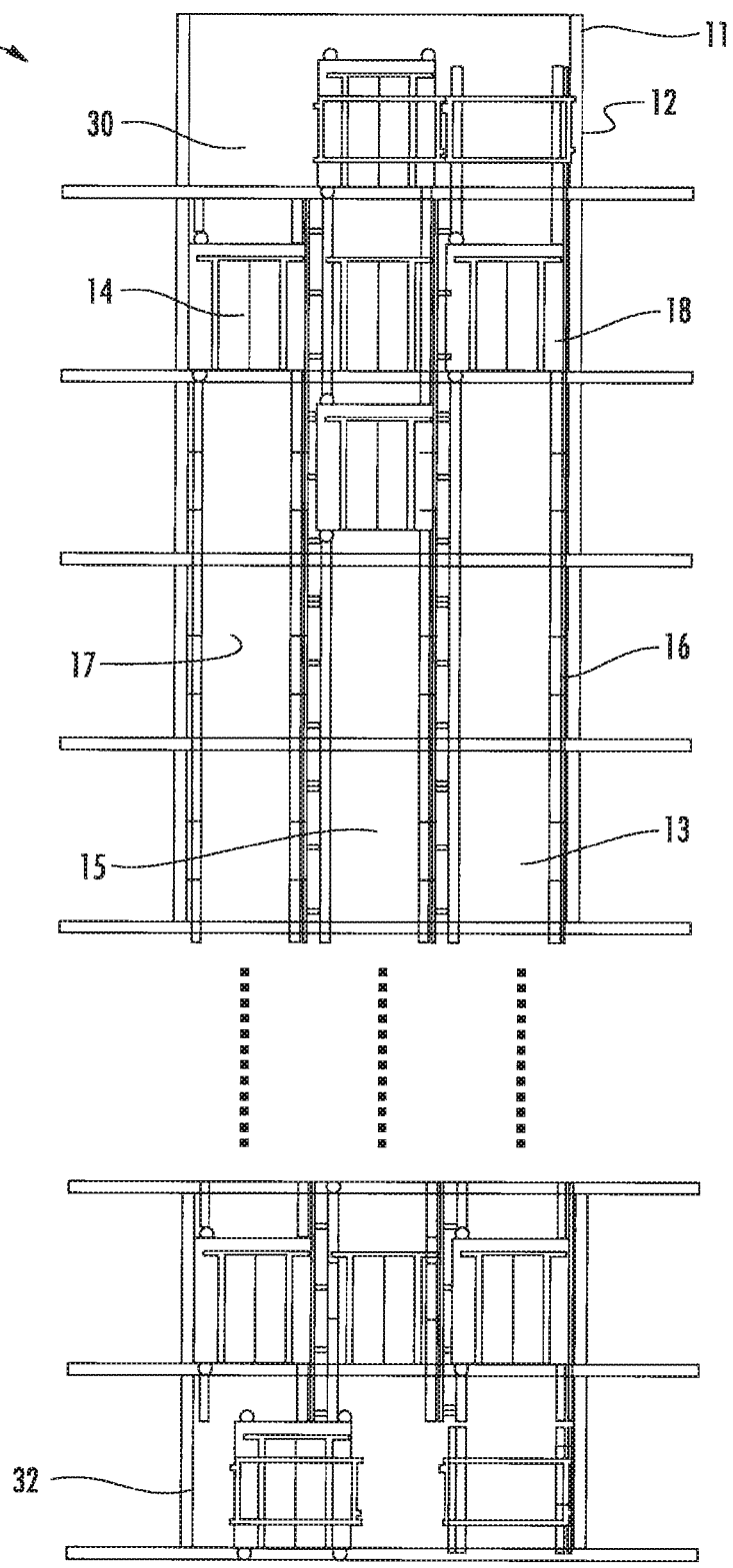
FIG. 1 schematically depicts a non-limiting exemplary embodiment of a multiple-car, ropeless elevator system.

FIG. 1 depicts a non-limiting exemplary embodiment of a multi-car, ropeless elevator system 10. The elevator system

10 includes a hoistway 11 having a plurality of lanes 13, 15, 17. While three lanes 13, 15, 17 are shown in FIG. 1, it should be readily appreciated that other embodiments of the elevator system 10 may have any suitable respective number of lanes. In each lane 13, 15, 17, one or more elevator cars 14 travel in one direction (i.e., up or down). For example, in FIG. 1, the cars 14 in lanes 13 and 15 travel up, and the cars 14 in lane 17 travel down.

Above the top floor of the hoistway 11 is an upper transfer station 30 to impart horizontal motion to the cars 14 to move the cars 14 between and among the lanes 13, 15, 17. It should be readily appreciated that the upper transfer station 30 may be located at the top floor rather than above the top floor. Below the first floor of the hoistway 11 is a lower transfer station 32 to impart horizontal motion to the cars 14 to move the cars 14 between and among the lanes 13, 15, 17. It should be readily appreciated that the lower transfer station 32 may be located at the first floor rather than below the first floor. Although not shown in FIG. 1, at least one intermediate transfer station may be used between the first and top floors. Each intermediate transfer station is similar to the upper and lower transfer stations 30, 32.

The cars 14 are propelled using a linear motor system having a primary, fixed portion 16 and a secondary, moving portion 18. The primary portion 16 includes windings or coils mounted at least one side of each lane 13, 15, 17. The primary portion 16 also is supplied with drive signals to control movement of the cars 14 in their respective lanes. The secondary portion 18 includes permanent-magnet arrays mounted to at least one side of each car 14 and is designed to react to large loads.

As shown in FIG. 1, adjacent lanes 13, 15, 17 share a guiderail 12 (or safety rail 12) such that, for example, an interior side of the car 14 in lane 13 and a corresponding side of the car 14 in lane 15 travel along a common guiderail. Also, as shown in FIG. 1 and described below, in each lane 13, 15, 17, at least one lower car 14 is positioned below an upper car 14, both cars 14 configured to move within the lane 11 as known.

It should be readily appreciated that the elevator system 10, in general, and the hoistway 11, upper and lower transfer stations 30, 32 (and any intermediate transfer station), and linear motor system, in particular, can have any suitable structure. It should also be readily appreciated that the hoistway 11, lanes 13, 15, 17, upper and lower transfer stations 30, 32 (and any intermediate transfer station), and linear motor system can have any suitable relationship with each other. It should also be readily appreciated that each of the cars 14 can move within the hoistway 11 and in the corresponding lane 13, 15, 17 in any suitable manner. It should also be readily appreciated that any suitable number of cars 14 can travel in a corresponding lane in any suitable direction. It should also be readily appreciated that each of the transfer stations 30, 32 can impart horizontal motion to the cars 14 in any suitable manner. It should also be readily appreciated that the cars 14 can be propelled using any suitable propulsion system—e.g., an on-board propulsion (e.g., rotary magnetic screws) such that structure of each car 14 may be more similar to that of a conventional rope-elevator car including a frame through which propulsion is directed.

Figure 2:
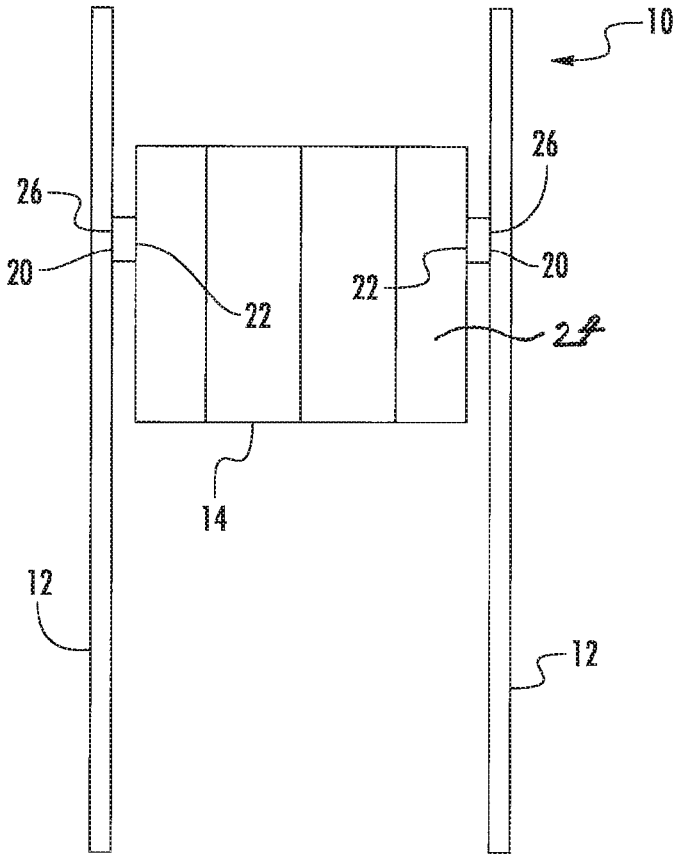
FIG. 2 schematically depicts a car portion of the embodiment of the elevator system illustrated in FIG. 1.

FIG. 2 schematically depicts a car portion of the embodiment of the elevator system 10. Movement of the car 14 along the guiderails 12 is facilitated in a known manner, such as by a plurality of guide-roller devices (not shown). A braking force is applied to prevent undesired movement of each car 14, such as when the car 14 is in an "over-speed"

condition, stopped at a desired position and needs to be held there, or unexpectedly moved.

However, it should be readily appreciated that movement of the car 14 along the guiderails 12 can be facilitated in any suitable manner. It should also be readily appreciated that a braking force can be applied to prevent any suitable movement of the car 14.

Toward that end, at least one safety or braking device 20 is supported between the car 14 and corresponding guiderail 12 for movement with the car 14 along the guiderail 12. (In the figure, a pair of braking devices 20 are supported between the car 14 and corresponding guiderails 12 for such movement.) The braking device 20 can take the form of a bar, linkage, or any other suitable structure. In any event, the braking device 20 includes a base portion 22 that is directly or indirectly mounted on an appropriate portion, such as a frame member 24, of the car 14. The base portion 22 remains stationary relative to the car 14 and moves vertically with the car 14. The braking device 20 includes also an opposed portion 26 that is directly or indirectly supported on an appropriate portion of the guiderail 12. The opposed portion 26 remains stationary relative to the car 14 and moves vertically with the car 14 as well. The opposed portion 26 may include friction components (e.g., wedges) that engage the guiderail 12 to stop the car 14.

Figure 3A:
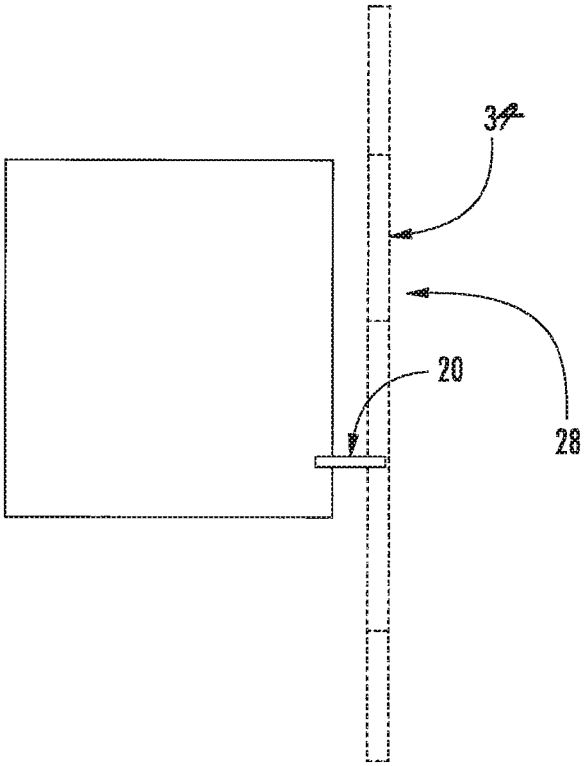
FIG. 3A schematically depicts a front view of a non-limiting exemplary embodiment of an assembly for actuating and controlling braking of a car of the embodiment of the elevator system illustrated in FIG. 1.
Figure 3B:
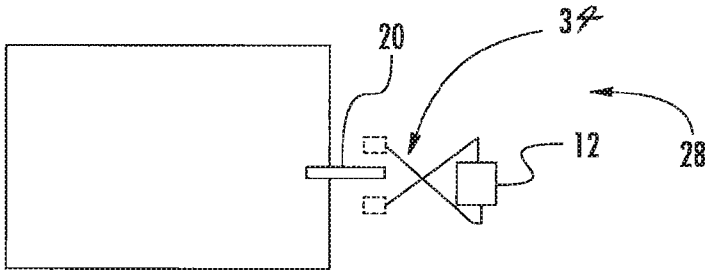
FIG. 3B schematically depicts a top view of the embodiment of the brake-actuation-and-control assembly illustrated in FIG. 3A.

FIGS. 3A and 3B depict, respectively, front and top views of a non-limiting exemplary embodiment of an assembly 28 for actuating and controlling braking of the car 14. The assembly 28 includes at least one blade or actuator 34 supported by the building in which the elevator system 10 resides. In an aspect of the embodiment, the actuator 34 is supported by a wall of the hoistway 11. In a version of this aspect, the actuator 34 is supported by a corresponding guiderail 12. Each braking device 20 is configured to selectively engage the actuator 34 to activate the braking device 20 to prevent undesired movement of the car 14. More specifically, the actuator 34 is configured to be retracted to allow, for example, a downward traveling car 14 to move past the location of the actuator 34 in a corresponding "safe zone" of the hoistway 11. When the actuator 34 is retracted, the braking device 20 is able to avoid contact with the actuator 34 and roll past the actuator 34 during movement of the car 14 to keep the braking device 20 in a position where the braking device 20 does not apply a braking force to the guiderail 12. The actuator 34 is also configured to be extended to interfere with the corresponding braking device 20 to stop or hold the car 14. When the actuator 34 is located, say, just below the car 14 and extended, any movement of the car 14 downward causes the braking device 20 to engage the actuator 34 and stop the car 14.

In an aspect, a series of actuators 34 is located along the hoistway 11 each of which is capable of engaging a braking device 20, regardless of location of the corresponding car 14 in the hoistway 11. In a version of this aspect, to create the "safe zone," a set of the series of actuators 34 is retracted such that a car 14 can move through the space created by the retracted set of actuators 34.

In an aspect and as shown in these figures, each braking device 20 can include, for instance, self-locking wedge-style brake members that are situated for engaging the actuator 34. In this way, the act of raising wedges of the braking device 20 of a downward traveling car 14 causes the wedges to clamp against the guiderail 12 to stop or hold the car 14. Toward that end, the actuator 34 in this aspect is a clamp-type actuator 34 and shown in a retracted state in FIG. 3B. The actuator 34 retracts to allow the car 14 to move past the location of the actuator 34 in the hoistway 11 or extends to interfere with a portion of (e.g., a linkage) the corresponding braking device 20 to trigger the brake device to stop or hold the car 14. When the actuator 34 is located just below the car 14 and in the extended position, any movement of the car 14 downward causes the braking device 20 to engage the actuator 34, activating the braking device 20 and stopping the car 14. Movement of the car 14 upward disengages the wedges.

It should be readily appreciated that each of the guiderail 12, braking device 20, and actuator 34 can have any suitable structure and the guiderail 12, car 14, braking device 20, and actuator 34 can have any suitable relationship with each other. For example, the braking device 20 can include instead rollers that are situated for engaging the actuator 34. It should also be readily appreciated that one or both of the braking devices 20 can be operating at any given time. It should also be readily appreciated that, although the assembly 28 is described above in connection with only a downward traveling car 14 (i.e., controlling movement of a car 14 in only one direction), the assembly 28 can be suitably implemented with an upward traveling car 14 as well (i.e., controlling movement of the car 14 in both directions).

Under selected conditions, it is desirable to apply a braking force using the braking device(s) 20. At least one controller or drive (not shown) is programmed to determine when such a condition exists in which it is desired to control the actuator 34 to apply each braking device 20 (i.e., "unsafe zones"). If such a condition exists, the controller(s) activate (s) the actuator(s) 34 for applying the braking force using the respective braking device(s) 20. It should be readily appreciated how to configure or program the controller(s) and what type of software, hardware, firmware, or any combination of these best meet the needs of any particular situation. The controller(s) is/are programmed with a variety of conditions for selectively controlling the actuator(s) 34 for controlling the application of braking force(s) using the braking device(s) 20. In an aspect, each individual controller can be configured to control the primary portion 16 (of the motor system) and actuator(s) 34 in a same general location of the hoistway 11.

By way of example only and not by way of limitation, the actuator 34 can include a pair of coils that receive electrical power through a link between the controller and actuator 34. The link allows the controller to selectively control application of the actuator 34 and includes a hard-wired connection to a source of power or wireless signal transmission between the controller and actuator 34. A post can be normally biased away from the actuator 34 and toward the car 14 by a spring. When the coils are energized, the posts can be retracted in a direction toward the actuator 34. In this retracted position, the braking device 20 avoids contact with the actuator 34. A control algorithm identifies the "safe zones" into which the cars 14 can move and retracts the respective actuators 34 in such zones. The actuators 34 positioned in the "unsafe zones," especially space defined by and between adjacent cars 14, are extended to activate the respective braking devices 20 and prevent any contact between the cars 14.

More specifically, in this example, in the event that the controller determines that it is desirable to control movement of a car 14 using the braking device(s) 20, the controller controls deactivation of the coils to allow the springs to urge the stop members of the actuator(s) 34 into engagement with the braking device(s) 20. By de-energizing the coils, the stop members are urged into engagement with the braking device(s) 20. Any downward movement of the car 14 in this condition results in triggering of the braking device(s) 20 to engage the guiderail 12. This results in applying a braking force that prevents further movement of the car 14.

Once the controller determines that it is no longer desired to apply a braking force using the braking device(s) 20, the controller appropriately controls the respective actuator(s) 34 (e.g., re-energizes the coils), and stop members are retracted away from the braking device(s) 20. Upward movement of the car 14 releases the braking device(s) 20.

Another example of an "unsafe zone" is at a landing during, for example, loading or unloading of a car 14 where the car 14 can move relatively slightly. The car 14 can be controlled by the assembly 28 in a manner that facilitates prevention of such movement. When the car 14 is stopped in a desired position at the landing, the controller controls each actuator 34 to apply the respective braking device 20. In the event that the load on the car 14 changes significantly such that there would be a perceived bouncing of the car 14 relative to the landing, the braking device 20 operates to prevent such movement of the car 14 relative to the landing outside of a desired range. An acceptable range of movement of the car 14 can be set when the car 14 is otherwise stopped using a brake associated with the elevator system 10 as known.

It should be readily appreciated that it can be desired to control the actuator 34 in any suitable existing condition. It should also be readily appreciated that the controller can programmed to determine when the conditions exist in any suitable manner. It should also be readily appreciated that the link can include any suitable type of connection or transmission between the controller and actuator 34. It should also be readily appreciated that the control algorithm can identify the "safe zones" and "unsafe zones" in any suitable manner. It should also be readily appreciated that the "safe zones" and "unsafe zones" can be defined in any suitable respective regions of the hoistway 11.

The assembly 28 is useful for controlling movement of a car 14 and applying a braking force to prevent the "overspeed" condition or unexpected or undesired movement of the car 14. The controller obtains information from known devices or techniques for determining when such a condition exists. It should be readily appreciated how to configure or program the controller for that purpose according to particular needs.

The assembly 28 locates the actuators 34 for the respective braking devices 20 in the hoistway 11 (not on the cars 14). Also, the system 10 eliminates communication between the cars 14 and respective drives and, thereby, makes the system 10 more robust and simple. Furthermore, the system 10 significantly reduces power requirements of the cars 14 and, thus, saves cost, weight, and life. In addition, the system 10 singularly and safely assures that the cars 14 neither contact each other nor have to take any action on their own for them to be stopped and held.

While the invention has been described in detail in connection with only a limited number of embodiments, it should be readily appreciated that the invention is not limited to such disclosed embodiments. Rather, the invention can be modified to incorporate any number of variations, alterations, substitutions, or equivalent arrangements not heretofore described, but which are commensurate with the spirit and scope of the invention. Additionally, while various non-limiting embodiments of the invention have been described, it is to be readily appreciated that aspects of the invention may include only some of the described embodiments. Accordingly, the invention is not to be seen as limited by the foregoing description, but is only limited by the scope of the appended claims.

The invention claimed is:

1. An assembly for actuating and controlling braking of a car of an elevator system, the assembly comprising:

at least one braking device mounted on the car, supported between the car and a hoistway for movement with the car within the hoistway, and configured to apply a braking force to the car, the car propelled using a linear motor system; and a series of actuators at spaced locations and supported by the hoistway, each actuator of the series of actuators configured to selectively engage the braking device to prevent movement of the car, each actuator of the series of actuators configured to engage the braking device in response to an overspeed condition of the car.

2. The assembly of claim 1, wherein the braking device is mounted on a frame member of the car.

3. The assembly of claim 1, wherein the actuator is supported by a corresponding guiderail of the hoistway.

4. The assembly of claim 1, wherein each actuator of the series of actuators is configured to be retracted to allow the car to move past a location of the actuator in the hoistway and extended to interfere with the corresponding braking device to stop the car.

5. The assembly of claim 4, wherein each actuator of the series of actuators includes a spring biasing the actuator in the extended position and a coil to move the actuator into the retracted position.

6. The assembly of claim 1, wherein a controller is programmed to activate and control each actuator of the series of actuators to apply the braking force using the braking device.

7. The elevator system of claim 1, wherein a controller is programmed to activate and control each actuator of the series of actuators to apply the braking force using the braking device.

8. An elevator system comprising:

a hoistway;

at least one car supported for vertical movement in a lane of the hoistway;

a linear motor system configured to propel the car; and an assembly for actuating and controlling braking of the car, the assembly including:

at least one braking device mounted on the car, supported between the car and the hoistway for movement with the car within the hoistway, and configured to apply a braking force to the car; and a series of actuators at spaced locations and supported by the hoistway, each actuator of the series of actuators configured to selectively engage the braking device to prevent movement of the car, each actuator of the series of actuators configured to engage the braking device in response to an overspeed condition of the car.

9. The elevator system of claim 8, wherein the braking device is mounted on a frame member of the car.

10. The elevator system of claim 8, wherein each actuator of the series of actuators is supported by a corresponding guiderail of the hoistway.

11. The elevator system of claim 8, wherein each actuator of the series of actuators is configured to be retracted to allow the car to move past a location of each actuator of the series of actuators in the hoistway and extended to interfere with the corresponding braking device to stop the car.

12. The assembly of claim 11, wherein each actuator of the series of actuators includes a spring biasing the actuator in the extended position and a coil to move the actuator into the retracted position.

13. The elevator system of claim 8, wherein a set of the series of actuators is retracted to create a safe zone of the hoistway through which the car can move.

* * * * *